US007159540B2

(12) United States Patent
Garrabrant et al.

(10) Patent No.: US 7,159,540 B2
(45) Date of Patent: Jan. 9, 2007

(54) WATER HEATER WITH AIR INTAKE AND EXHAUST SYSTEM

(75) Inventors: Michael Garrabrant, Unicoi, TN (US); James York, Gray, TN (US); Jeff Lyons, Gray, TN (US); Tim Smith, Blountville, TN (US); Roger Gillespie, Brisol, TN (US)

(73) Assignee: American Water Heater Company, Atlanta, GA (US)

( * ) Notice: Subject to any disclaimer, the term of this patent is extended or adjusted under 35 U.S.C. 154(b) by 0 days.

(21) Appl. No.: 10/969,741

(22) Filed: Oct. 20, 2004

(65) Prior Publication Data

US 2006/0081198 A1 Apr. 20, 2006

(51) Int. Cl.
*F24H 1/18* (2006.01)

(52) U.S. Cl. ..... 122/13.01; 122/18.3

(58) Field of Classification Search ..... 122/13.01, 122/14.1, 18.3, 19.1, 155.1, 14.2; 126/361.1
See application file for complete search history.

(56) References Cited

U.S. PATENT DOCUMENTS

| | | | | |
|---|---|---|---|---|
| 646,863 | A | | 4/1900 | McNaughton et al. |
| 886,391 | A | | 5/1908 | Moore |
| 2,334,389 | A | * | 11/1943 | Farren et al. ..... 122/14.1 |
| 3,091,223 | A | | 5/1963 | Vitale |
| 3,707,142 | A | | 12/1972 | Kobayashi |
| 4,262,608 | A | | 4/1981 | Jackson |
| 4,338,888 | A | | 7/1982 | Gerstmann et al. |
| 4,712,515 | A | | 12/1987 | Couprie |
| 4,869,232 | A | * | 9/1989 | Narang ..... 122/14.1 |
| 4,940,042 | A | | 7/1990 | Moore, Jr. et al. |
| 5,012,793 | A | | 5/1991 | Guzorek |
| 5,020,512 | A | | 6/1991 | Vago et al. |
| 5,697,330 | A | * | 12/1997 | Yetman et al. ..... 122/14.21 |
| 5,794,609 | A | * | 8/1998 | Grant ..... 122/13.01 |
| 6,622,660 | B1 | * | 9/2003 | Bajic et al. ..... 122/13.01 |

* cited by examiner

*Primary Examiner*—Gregory Wilson
(74) *Attorney, Agent, or Firm*—DLA Piper US LLP

(57) ABSTRACT

A water heater including a water container; a combustion chamber adjacent the water container; a burner associated with the combustion chamber; a blower assembly located to receive combustion products generated by the burner; an intake conduit sealingly connected to the combustion chamber and having a combustion air intake opening located adjacent an upper portion of the water heater; and a dilution air conduit sealingly connected to the blower assembly and having a dilution air intake opening located adjacent a lower portion of the water heater.

27 Claims, 4 Drawing Sheets

WATER HEATER WITH AIR INTAKE AND EXHAUST SYSTEM

FIELD OF THE INVENTION

This invention relates to power vented water heaters, particularly to a power vented water heater that has an air intake and exhaust system to reduce the potential for flammable vapor ignition.

BACKGROUND

Power vented water heaters are often equipped with intermittent burner ignition devices such as spark or hot surface igniters that ignite the pilot or main burner system only when there is a demand for hot water. Alternatively, the pilot burner may continuously operate in standing pilot type of ignition systems. Standing pilot ignition systems are less energy efficient and are manually re-lit after a power outage. This results in a significant preference in the market place for intermittent ignition systems.

However, intermittent ignition systems pose challenges regarding reducing the likelihood of igniting flammable vapors outside the power vented water heater since typical flame arrestor technology using intermittent ignition systems has proven challenging. A power vented water heater uses a blower positioned directly above the flue to move combustion products from the ambient space surrounding the heater into the water heater and exhaust the products of combustion outside. Typical power vented water heaters have two sources of intake air. One source is for combustion, wherein combustion air flows through the combustion chamber and flue. One source causes air to flow directly into the blower to reduce the temperature of the exhaust gases. This allows the vent system to utilize PVC, ABS or CPVC venting. When the water heater burner is off (i.e., in standby mode), the blower does not operate nor is there pilot or main burner operation. When there is a call for heat, the blower typically operates for a short pre-purge period to establish that there is sufficient airflow through the water heater system to support combustion and vent combustion products outside. If there are flammable vapors in the vicinity of the water heater, they may be drawn into the combustion chamber and, upon activation of the pilot ignition device or main burner, the accumulated vapors can ignite in an undesired manner.

SUMMARY OF THE INVENTION

This invention relates to a water heater including a water container, a combustion chamber adjacent the water container, a burner associated with the combustion chamber, a blower assembly located to receive combustion products generated by the burner, an intake conduit sealingly connected to the combustion chamber and having a combustion air intake opening located adjacent an upper portion of the water heater, and a dilution air conduit sealingly connected to the blower and having a dilution air intake opening located adjacent a lower portion of the water heater.

DETAILED DESCRIPTION

Figure 1:
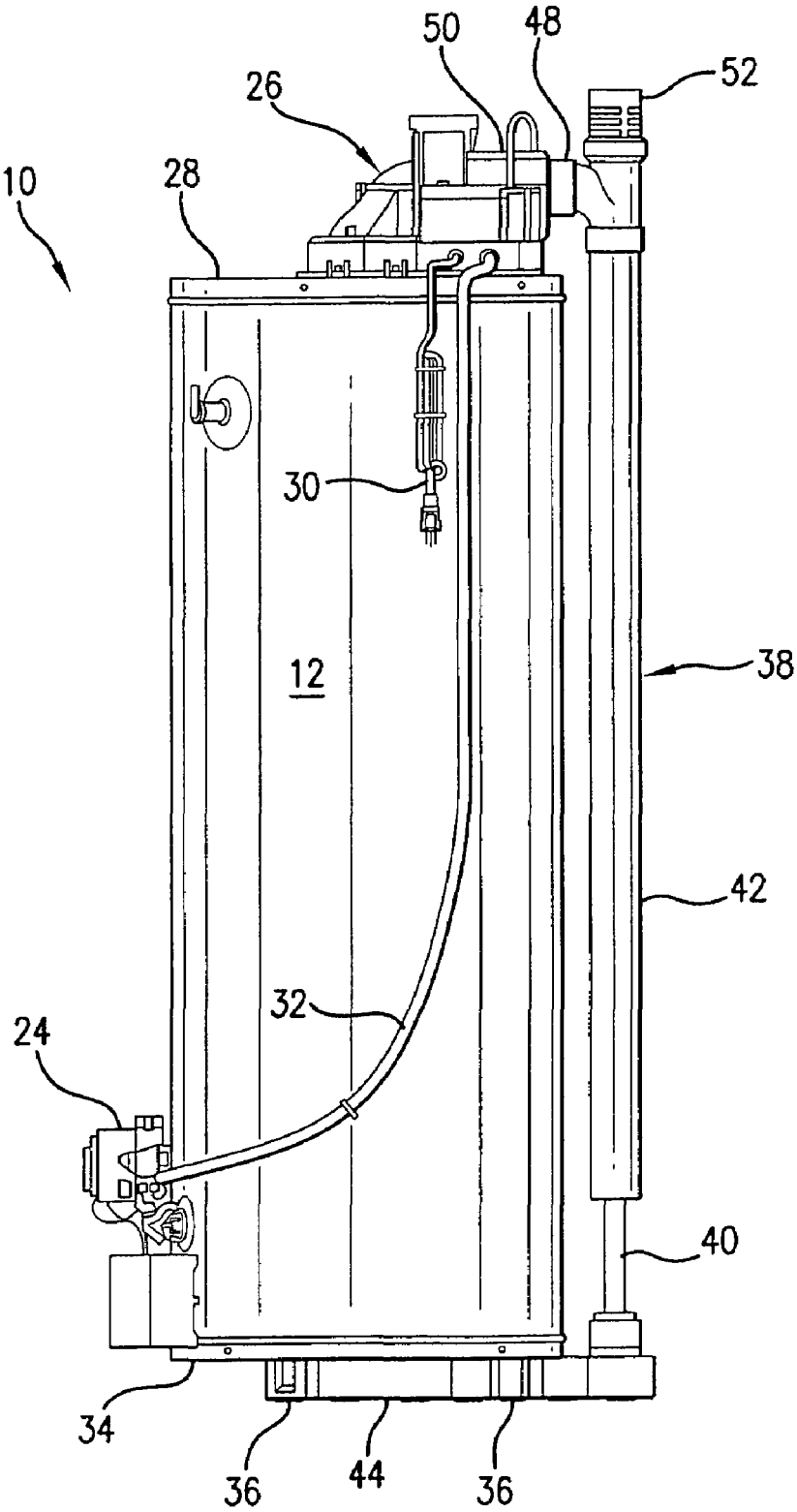
FIG. 1 is a side elevational view of a water heater in accordance with aspects of the invention.

It will be appreciated that the following description is intended to refer to specific aspects of the invention selected for illustration in the drawings and is not intended to define or limit the invention, other than in the appended claims.

This invention assists in reducing the likelihood that flammable vapors outside a water heater will reach the combustion chamber where they may be ignited by the main burner or pilot ignition device. This is achieved in one aspect with a concentric, bi-directional air intake system that directs separate air intake paths to the water heater blower and vent system. One air intake path provides air for combustion and may be located above the dilution air intake for the blower. The intake pipe may be a large diameter pipe that allows air for dilution of the combustion exhaust products to be drawn from below the heater (preferably less than about 18 inches from the floor) and directly into the blower and exhausted to the outside. Inside of the large diameter air intake pipe is a smaller pipe that permits air for combustion to be drawn from the top of the water heater or above the blower and travel down to a sealed combustion chamber. These bi-directional air paths are separate and do not intermix.

Turning now to the drawings, a water heater 10 in accordance with selected aspects of the invention is shown. Water heater 10 includes, but is not limited to, a jacket 12, insulation 14, tank 16, combustion chamber 18 and burner 20. A flue 22 extends longitudinally substantially concentrically within tank 16 from an uppermost portion (tank head) to a lowermost portion (tank bottom). Combustion chamber 18 contains burner 20 which connects to a fuel supply line 22. Fuel supply line 23 connects to gas control valve 24 that connects to a fuel supply (not shown).

A blower assembly 26 is positioned on the top pan 28 of water heater 10 and sealingly connects to flue 22 at its upper terminus. Accordingly, exhaust/combustion gases generated by burner 20 flow upwardly through flue 22 and into blower assembly 26. Blower assembly 26 has an electrical supply cord 30 that may be "plugged in" a typical electrical residential household socket. Various electric control lines may be contained within a conduit 32 connected between blower assembly 26 and gas valve 24.

Water heater 10 has a bottom pan 34, i.e., the bottom of the jacket. Bottom pan 34 has an opening 46 through which passes combustion air and rests on legs 36 that support the entire water heater 10.

An air intake system 38 connects between blower assembly 26 and combustion chamber 18. Air intake system 38 includes an air intake conduit and a dilution air conduit. The air intake conduit includes a substantially vertically oriented portion 40 that extends alongside or adjacent jacket 12 of water heater 10. The air intake conduit also comprises a substantially horizontally oriented portion 44 that extends from the substantially vertically oriented portion 40 to opening 46 in bottom pan 34. Substantially vertically oriented portion 40 may extend upwardly beyond the top of blower assembly 26.

The dilution air conduit includes a substantially vertically oriented portion 42 that extends alongside or adjacent jacket 12. The dilution air conduit also includes a connector portion 48 that extends between blower assembly 26 and substantially vertically oriented portion 42. Substantially vertically oriented portion 42 preferably has a perforated cap 52 at its uppermost portion and is positioned to allow ambient air to enter through the perforated cap and through an open end of substantially vertically oriented portion 40. Portions of substantially vertically oriented portion 40 and substantially vertically oriented portion 42 are preferably concentric.

During operation, burner 20 generates combustion/exhaust gases. Blower 50 initiates a flow of air and exhaust gases upwardly through flue 22. This also causes an upward flow of air/exhaust gases through combustion chamber 18. This in turn causes flow of air through opening 46 in bottom pan 34, which in turn causes flow of air through substantially horizontal portion 44 and substantially vertical portion 40. Combustion air enters air intake and exhaust system 38 by way of perforations in cap 52 as shown by arrows "A" in FIG. 3. Then, air flows downwardly through vertically oriented portion 40 as shown by arrow "B", into horizontally oriented portion 44, upwardly through opening 46 and into combustion chamber 18.

Figure 2:
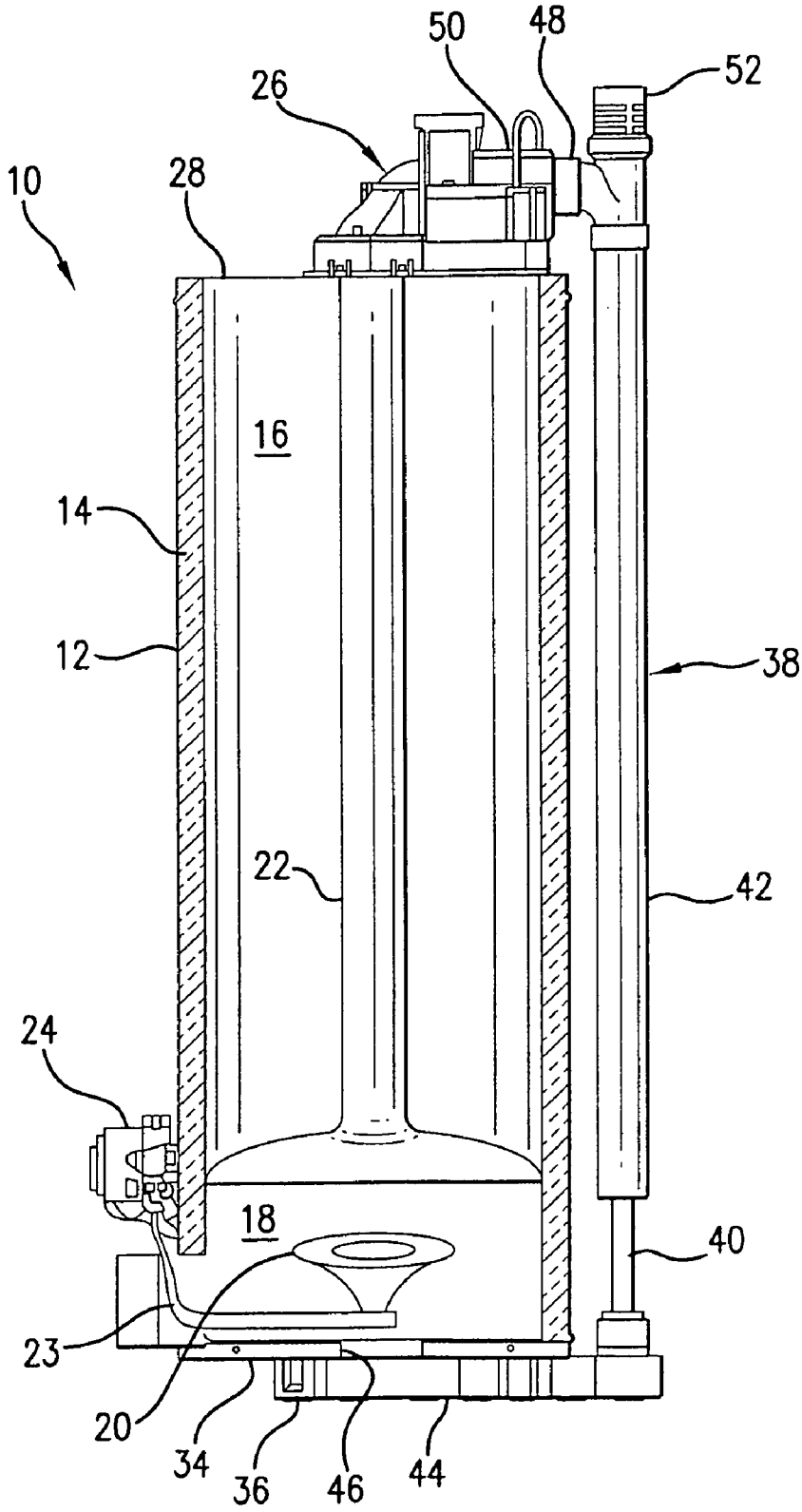
FIG. 2 is a partial sectional view of the water heater of FIG. 1.
Figure 4:
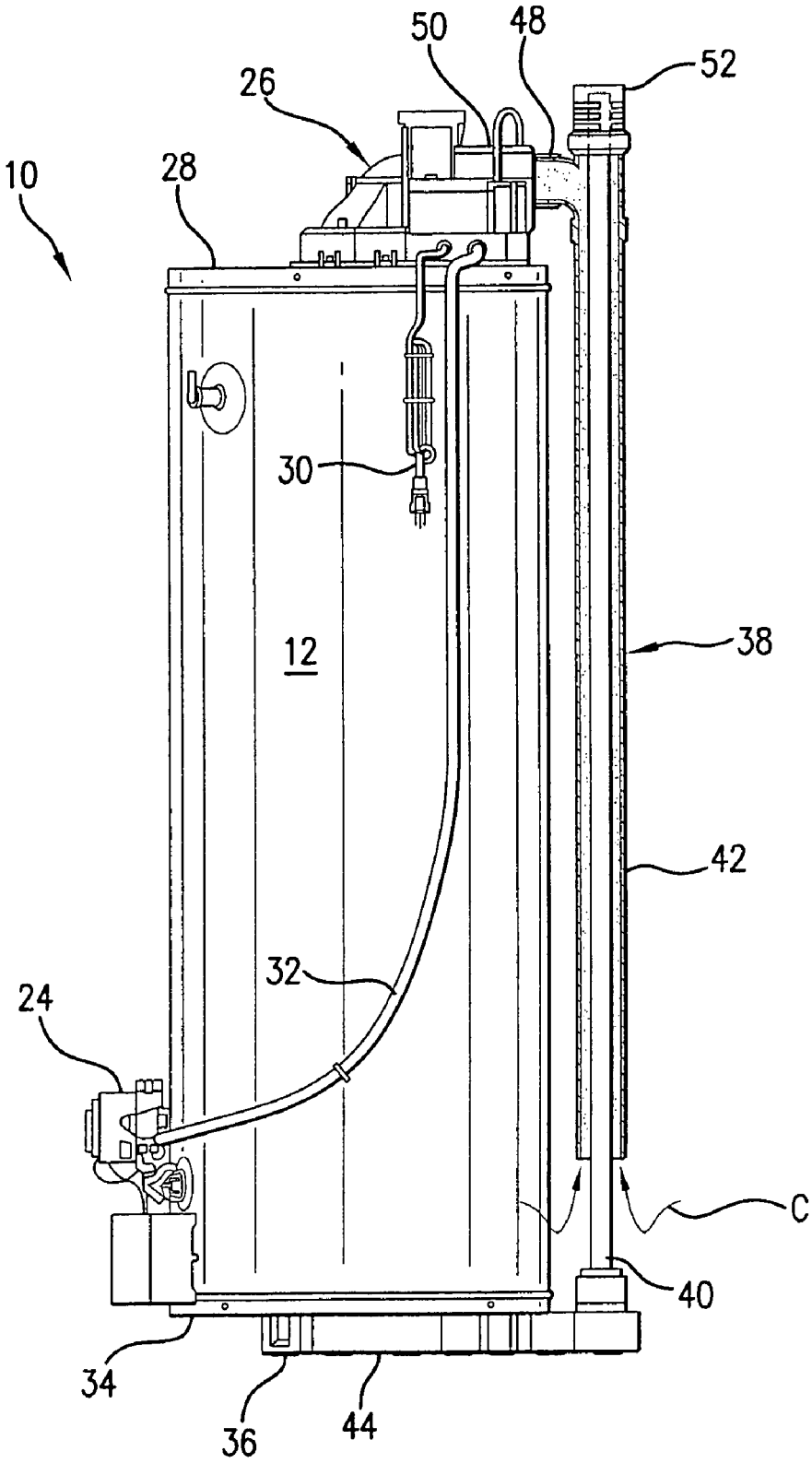
FIG. 4 is a partial sectional view of the water heater of FIG. 1.

Substantially simultaneously, as shown by reference to FIGS. 2 and 4, blower 50 causes the flow of air to supply air to the blower to mix with exhaust gases entering blower assembly 26 through flue 22, which decreases the temperature of the exhaust gases and provides for a range of types of exhaust lines (not shown), but which would extend in a direction "away" from water heater 10 in the Figures. The suction created by blower 50 causes dilution air to move through connector 48 and through substantially vertically oriented portion 42. With particular reference to FIG. 4, arrows "C" depict the entrance of dilution air through an opening in the lowermost portion of substantially vertically oriented portion 42. That lowermost opening is preferably less than about 18 inches from ground level. Dilution air flows upwardly through substantially vertically oriented portion 42, through connector 48 and into blower 50 for combination with exhaust gases exiting from the terminus of flue 22.

Figure 3:
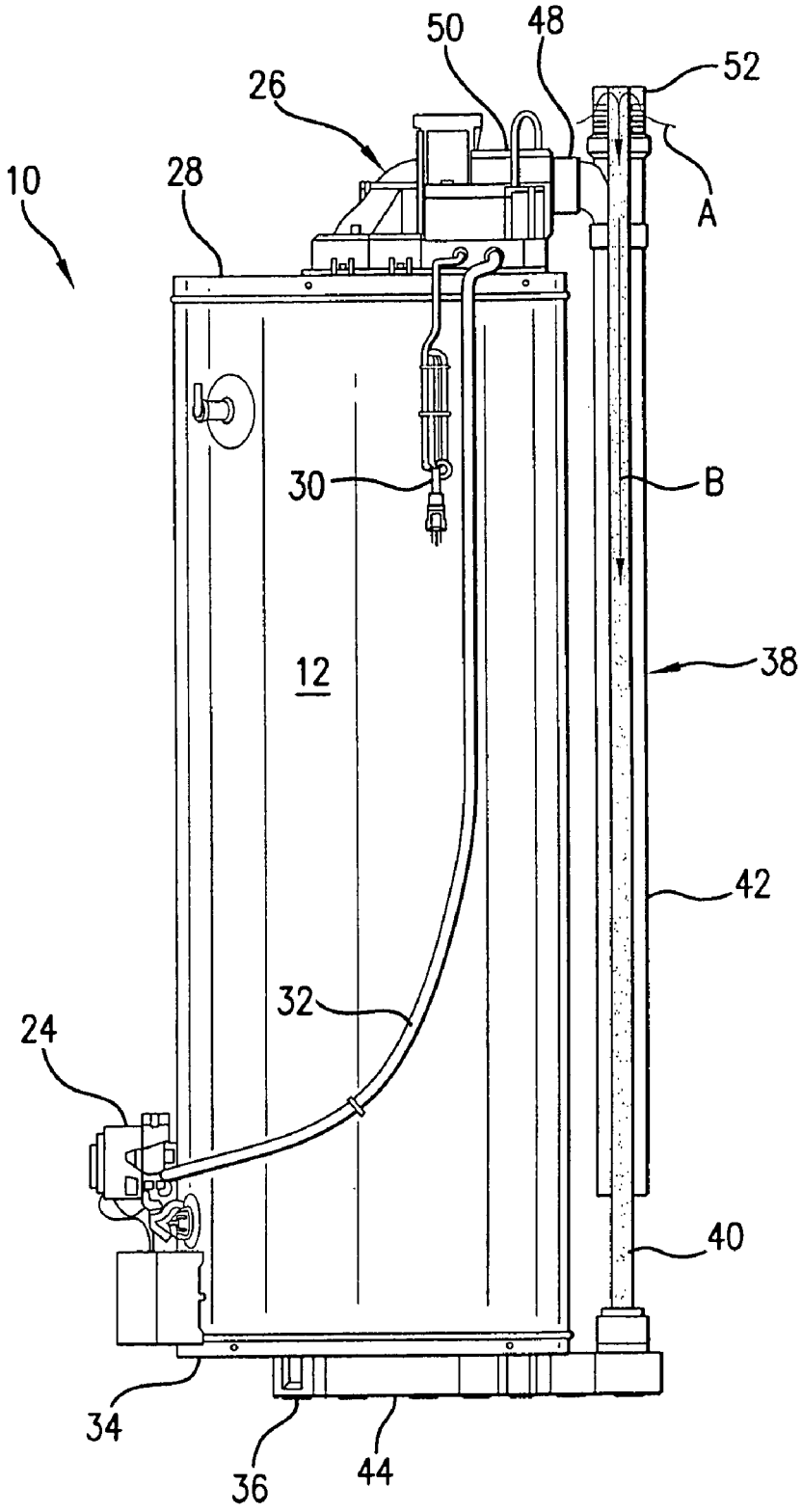
FIG. 3 is a partial sectional view of the water heater of FIG. 1.

It can be seen, especially as shown in FIGS. 3 and 4, that simultaneous intake combustion air and dilution air can occur from different locations and without intermixing. This can be achieved by the seal between combustion air pipe 40 and dilution air pipe 42. This simultaneous flow reduces the chances of undesirable flammable ignition of vapors that might be located adjacent the water heater and provides for a means to lower the temperature of exhaust gases to increase flexibility of installation of the water heater.

Typical gasoline spills or other flammable vapors tend to migrate near the floor and be drawn into the dilution air intake and exhaust harmlessly outside with the products from combustion. Due to the difference in magnitude of the volume of the separate air paths (20% combustion air, 80% dilution air) drawn into each conduit, it is less likely that vapor concentrations will exceed the lower flammability limit at the combustion air inlet. This invention thereby reduces the propensity for flammable vapors to enter the combustion chamber where they could be ignited and can evacuate the flammable vapors from the space during operation, thereby reducing the potential that these vapors will build up and come in contact with another potential ignition source.

The size of the concentric portions can be increased or decreased to suit the application and/or size and/or shape of the water heater. The location of the various conduits relative to the water heater may also be varied depending on the size, shape and location of the water heater. The lower portion of the water heater may be the lower half of the water heater, but may be a larger portion so long as the dilution air intake opening is located below the combustion air opening. Conversely, the upper portion of the water heater may be the upper half of the water heater, but may be a larger portion so long as the combustion air opening is above, the dilution air intake.

It will be understood that water heater 10 may be constructed with a wide variety of materials, in a wide variety of shapes and sizes. For example, any number of types of burners 20 may be employed, along with various types of blower assemblies 26, gas control valves 24 and the like. Also, various types of insulation, water containers/tanks and jackets may be employed. Preferably, air intake system 38 is constructed of PVC, ABS or CPVC materials, although other suitable materials may be employed.

Although this invention has been described in connection with specific forms thereof, it will be appreciated that a wide variety of equivalents may be substituted for the specified elements described herein without departing from the spirit and scope of this invention as described in the appended claims.

What is claimed is:

1. A water heater comprising:

a water container;

a combustion chamber adjacent the water container;

a burner associated with the combustion chamber;

a blower assembly having a first blower assembly inlet connected to receive combustion products generated by the burner and a second blower assembly inlet;

an intake air conduit sealingly connected to the combustion chamber and having a combustion air intake opening located adjacent an upper portion of the water heater; and a dilution air conduit sealingly connected to the second blower assembly inlet and having a dilution air intake opening located adjacent a lower portion of the water heater.

2. The water heater of claim 1, wherein at least a portion of the dilution air conduit substantially concentrically surrounds at least a portion of the intake air conduit.

3. The water heater of claim 1, wherein the combustion air intake opening is located at a level higher than a location where the dilution air conduit connects to the blower assembly.

4. The water heater of claim 1, wherein the dilution air intake opening is less than about 18 inches above ground level.

5. The water heater of claim 1, wherein the intake conduit comprises a substantially vertically oriented portion extending along at least a portion of the length of the water heater, and a substantially horizontally oriented portion extending from the vertically oriented portion to an opening in the combustion chamber.

6. The water heater of claim 1, wherein the dilution air conduit comprises a substantially vertically oriented portion extending along at least a portion of the length of the water heater, and a connector portion extending between the blower assembly and the substantially oriented portion.

7. The water heater of claim 1, wherein the combustion air intake opening is covered with a perforated cap.

8. The water heater of claim 1, wherein the intake and dilution air conduits are substantially PVC, ABS and/or CPVC.

9. The water heater of claim 1, wherein the intake conduit comprises a substantially vertically oriented portion extending along at least a portion of the length of the water heater, and a substantially horizontally oriented portion extending from the vertically oriented portion to an opening in the bottom of the combustion chamber.

10. A water heater comprising:

a water container;

a combustion chamber adjacent the water container;

a burner associated with the combustion chamber;

a blower assembly having a first blower assembly inlet connected to receive combustion products generated by the burner and a second blower assembly inlet;

an intake conduit sealingly connected to the combustion chamber and having a combustion air intake opening located adjacent an upper portion of the water heater, the intake conduit comprising a substantially vertically oriented portion extending along at least a portion of the length of the water heater, and a substantially horizontally oriented portion extending from the vertically oriented portion to an opening in the combustion chamber; and a dilution air conduit sealingly connected to the second blower assembly inlet and and having a dilution air intake opening located adjacent a lower portion of the water heater, the dilution air conduit comprising a substantially vertically oriented portion extending along at least a portion of the length of the water heater, and a connector portion extending between the blower and the substantially oriented portion.

11. The water heater of claim 10, wherein at least a portion of the dilution air conduit substantially concentrically surrounds at least a portion of the intake air conduit.

12. The water heater of claim 10, wherein the combustion air intake opening is located at a level higher than a location where the dilution air conduit connects to the blower assembly.

13. The water heater of claim 10, wherein the dilution air intake opening is less than about 18 inches above ground level.

14. The water heater of claim 10, wherein the combustion air intake opening is covered with a perforated cap.

15. The water heater of claim 10, wherein the intake and dilution air conduits are substantially PVC, ABS and/or CPVC.

16. A water heater comprising:

a water container;

a combustion chamber adjacent the water container;

a burner associated with the combustion chamber;

a blower located to receive combustion products generated by the burner;

an intake air conduit sealingly connected to the combustion chamber and having a combustion air intake opening located adjacent an upper portion of the water heater; and a dilution air conduit sealingly connected to the blower and having a dilution air intake opening located adjacent a lower portion of the water heater, wherein at least a portion of the dilution air conduit substantially concentrically surrounds at least a portion of the intake air conduit.

17. The water heater of claim 16, wherein the combustion air intake opening is located at a level higher than a location where the dilution air conduit connects to the blower assembly.

18. The water heater of claim 16, wherein the dilution air intake opening is less than about 18 inches above ground level.

19. The water heater of claim 16, wherein the intake conduit comprises a substantially vertically oriented portion extending along at least a portion of the length of the water heater, and a substantially horizontally oriented portion extending from the vertically oriented portion to an opening in the combustion chamber.

20. The water heater of claim 16, wherein the dilution air conduit comprises a substantially vertically oriented portion extending along at least a portion of the length of the water heater, and a connector portion extending between the blower assembly and the substantially oriented portion.

21. The water heater of claim 16, wherein the combustion air intake opening is covered with a perforated cap.

22. A water heater comprising:

a water container;

a combustion chamber adjacent the water container;

a burner associated with the combustion chamber;

a blower assembly located to receive combustion products generated by the burner;

an intake air conduit sealingly connected to the combustion chamber and having a combustion air intake opening located adjacent an upper portion of the water heater;

a dilution air conduit sealingly connected to supply dilution air to the blower assembly and having a dilution air intake opening located adjacent a lower portion of the water heater; and wherein at least a portion of the dillution air conduit substantially concentrically surrounds at least a portion of the intake air conduit.

23. A water heater comprising:

a water container;

a combustion chamber adjacent the water container;

a burner associated with the combustion chamber;

a blower assembly having a first blower assembly inlet connected to receive combustion products generated by the burner and a second blower assembly inlet;

an intake conduit sealingly connected to supply combustion air to the combustion chamber and having a combustion air intake opening located adjacent an upper portion of the water heater, the intake conduit comprising a substantially vertically oriented portion extending along at least a portion of the length of the water heater, and a substantially horizontally oriented portion extending from the vertically oriented portion to an opening in the bottom of the combustion chamber; and a dilution air conduit sealingly connected to the second blower assembly inlet to supply dilution air to the blower assembly and having a dilution air intake opening located adjacent a lower portion of the water heater, the dilution air conduit comprising a substantially vertically oriented portion extending along at least a portion of the length of the water heater, and a connector portion extending between the blower assembly and the substantially vertically oriented portion.

24. A water heater comprising:

a water container;

a combustion chamber adjacent the water container;

a burner associated with the combustion chamber;

a blower assembly located to receive combustion products generated by the burner;

an intake air conduit sealingly connected to the combustion chamber and having a combustion air intake opening located adjacent an upper portion of the water heater; and a dilution air conduit sealingly connected to the blower assembly and having a dilution air intake opening located adjacent a lower portion of the water heater, and at least a portion of the dilution air conduit substantially concentrically surrounds at least a portion of the intake air conduit.

25. A water heater comprising:

a water container;

a combustion chamber adjacent the water container;

a burner associated with the combustion chamber;

a blower assembly located to receive combustion products generated by the burner;

a dilution air conduit sealingly connected to the blower assembly and having a dilution air intake opening located adjacent a lower portion of the water heater; and an intake air conduit sealingly connected to the combustion chamber and having a combustion air intake opening located adjacent an upper portion of the water heater at a level higher than a location where the dilution air conduit connects to the blower assembly.

26. A water heater comprising:

a water container;

a combustion chamber adjacent the water container;

a burner associated with the combustion chamber;

a blower assembly located to receive combustion products generated by the burner;

an intake conduit sealingly connected to the combustion chamber and having a combustion air intake opening located adjacent an upper portion of the water heater, the intake conduit comprising a substantially vertically oriented portion extending along at least a portion of the length of the water heater, and a substantially horizontally oriented portion extending from the vertically oriented portion to an opening in the combustion chamber; and a dilution air conduit sealingly connected to the blower assembly and having a dilution air intake opening located adjacent a lower portion of the water heater, the dilution air conduit comprising a substantially vertically oriented portion extending along at least a portion of the length of the water heater, and a connector portion extending between the blower assembly and the substantially vertically oriented portion, and at least a portion of the dilution air conduit substantially concentrically surrounds at least a portion of the intake air conduit.

27. A water heater comprising:

a water container;

a combustion chamber adjacent the water container;

a burner associated with the combustion chamber;

a blower assembly located to receive combustion products generated by the burner;

a dilution air conduit sealingly connected to the blower assembly and having a dilution air intake opening located adjacent a lower portion of the water heater, the dilution air conduit comprising a substantially vertically oriented portion extending along at least a portion of the length of the water heater, and a connector portion extending between the blower assembly and the substantially vertically oriented portion; and an intake conduit sealingly connected to the combustion chamber and having a combustion air intake opening located adjacent an upper portion of the water heater at a level higher than a location where the dilution air conduit connects to the blower assembly, the intake conduit comprising a substantially vertically oriented portion extending along at least a portion of the length of the water heater, and a substantially horizontally oriented portion extending from the vertically oriented portion to an opening in the combustion chamber.

* * * * *

UNITED STATES PATENT AND TRADEMARK OFFICE

CERTIFICATE OF CORRECTION

PATENT NO. : 7,159,540 B2
APPLICATION NO. : 10/969741
DATED : January 9, 2007
INVENTOR(S) : Michael Garrabrant et al.

It is certified that error appears in the above-identified patent and that said Letters Patent is hereby corrected as shown below:

In Column 5 (Claim 16), at line 46, after “blower”, please insert --assembly--.

In Column 5 (Claim 16), at line 52, after “blower”, please insert --assembly--.

Signed and Sealed this

Thirteenth Day of March, 2007

JON W. DUDAS
*Director of the United States Patent and Trademark Office*